United States Patent [19]

Kadleck et al.

[11] Patent Number: 4,875,585

[45] Date of Patent: Oct. 24, 1989

[54] CARTON HAVING A HORIZONTAL OBJECT HOLDING PANEL AND BLANK

[75] Inventors: Richard G. Kadleck, Berea; William W. Nowak, Broadview Heights, both of Ohio

[73] Assignee: The Shelby Paper Box Co., Westlake, Ohio

[21] Appl. No.: 166,532

[22] Filed: Mar. 10, 1988

Related U.S. Application Data

[60] Continuation-in-part of Ser. No. 140,158, Dec. 31, 1987, abandoned, which is a division of Ser. No. 897,498, Aug. 18, 1986, Pat. No. 4,735,314.

[51] Int. Cl.[4] ..... B65D 85/44; B65D 5/06

[52] U.S. Cl. ..... 206/426; 206/45.14; 206/196; 206/434; 229/40; 229/120.27

[58] Field of Search ..... 206/427, 429, 430, 434, 206/145, 147, 426, 45.14, 149, 155, 157, 174, 175–191; 229/40, 120.14, 120.15, 120.27

[56] References Cited

U.S. PATENT DOCUMENTS

| | | | |
|---|---|---|---|
| Re. 25,073 | 10/1961 | Phillips | 229/120.77 X |
| D. 207,805 | 5/1967 | Nowak . | |
| D. 211,139 | 5/1968 | Nowak . | |
| 917,177 | 3/1909 | Hilliker . | |
| 2,798,603 | 7/1957 | Grinspoon . | |
| 2,815,857 | 12/1957 | Sester . | |
| 2,817,473 | 12/1957 | Foster | 229/40 |
| 2,823,062 | 2/1958 | Toensmeier . | |
| 3,083,825 | 4/1963 | Larsen . | |
| 3,098,583 | 7/1963 | Sherman et al. | 229/40 |
| 3,156,404 | 11/1964 | Wood | 229/40 |
| 3,163,321 | 12/1964 | Weiss | 229/120.27 X |
| 3,194,476 | 7/1965 | Weiss | 229/40 |
| 3,263,893 | 8/1966 | Weiss | 206/196 |
| 3,281,180 | 10/1966 | Spery . | |
| 3,598,302 | 8/1971 | Nowak | 229/40 X |
| 3,854,580 | 12/1974 | Hennessey | 206/426 |
| 3,884,353 | 5/1975 | Forte | 206/426 |
| 4,381,057 | 4/1983 | Carver | 206/434 |
| 4,637,515 | 1/1987 | Wilson et al. | 206/434 |
| 4,640,417 | 2/1987 | Durand | 206/426 |
| 4,681,217 | 7/1987 | Hernandez | 206/434 X |
| 4,702,375 | 10/1987 | Wilson | 206/434 |
| 4,735,314 | 4/1988 | Kadleck et al. | 206/426 |

FOREIGN PATENT DOCUMENTS

| | | |
|---|---|---|
| 89608 | 7/1967 | France . |
| 2562513 | 10/1985 | France . |
| 448871 | 4/1968 | Switzerland . |
| 890068 | 2/1962 | United Kingdom . |
| 917670 | 2/1963 | United Kingdom . |

*Primary Examiner*—Bryon P. Gehman
*Attorney, Agent, or Firm*—Body, Vickers & Daniels

[57] ABSTRACT

A paperboard carton for drinking glasses directly engages stems or other irregularly shaped portions to rigidly and securely hold the glasses within the carton. The carton is erected from a blank form in a method requiring no direct manual manipulation to position the stem holding portion of the carton. The carton is formed as an open ended rectangular sleeve with a stem holding panel extending horizontally across the interior of the carton.

8 Claims, 5 Drawing Sheets

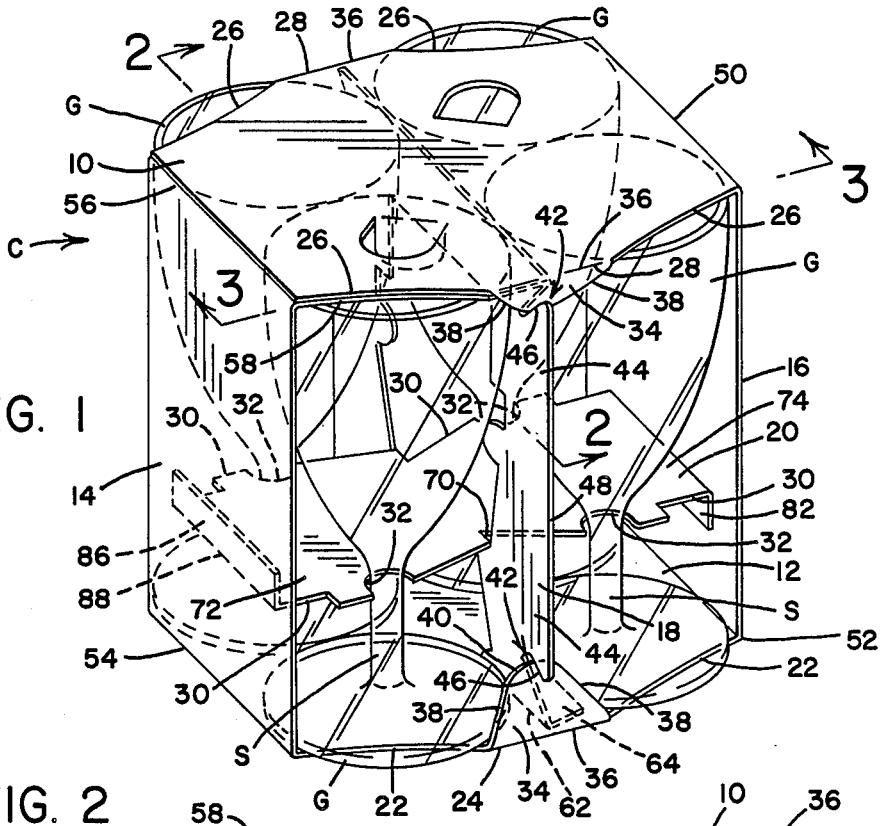
FIG. 1
FIG. 2
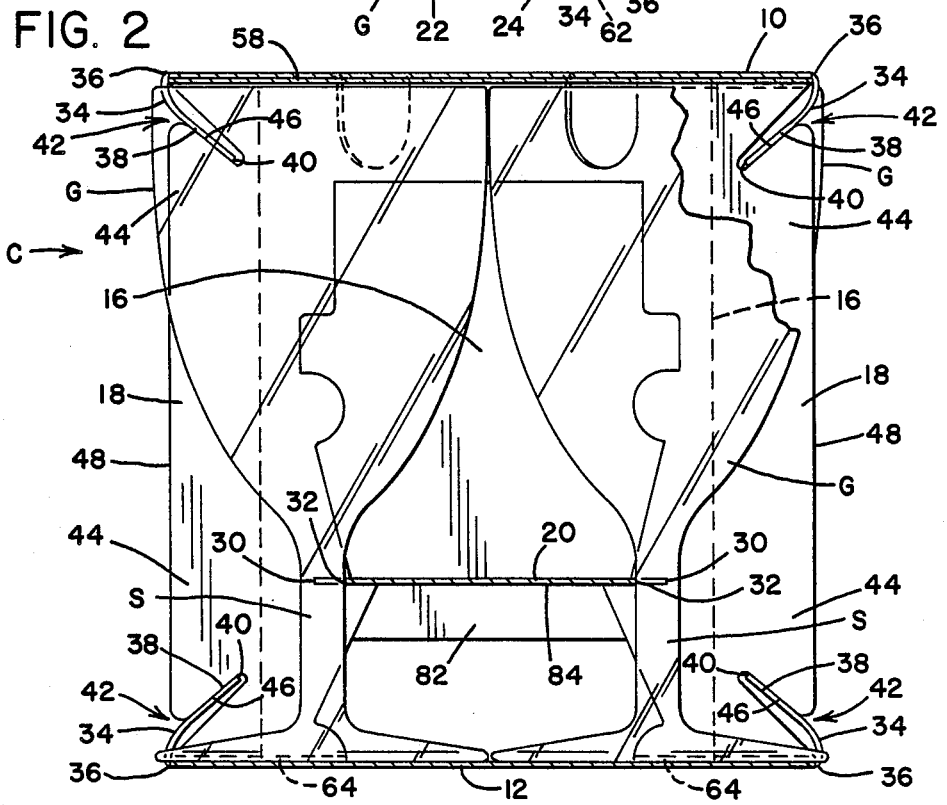

CARTON HAVING A HORIZONTAL OBJECT HOLDING PANEL AND BLANK

This is a continuation in part of copending application Ser. No. 140,158, filed Dec. 31, 1987, now abandoned which in turn is a division of application Ser. No. 897,498, filed Aug. 18, 1986, now U.S. Pat. No. 4,735,314 both of which are incorporated in their entireties by reference herein.

The present invention pertains to the art of folded paperboard cartons, and particularly to a paperboard carton for holding drinking glasses of various shapes.

BACKGROUND OF THE INVENTION

In my copending patent applications, a folded paperboard carton is disclosed which utilizes a unique tab and slot arrangement to securely retain drinking glasses or other objects within the carton. In this application, an improvement in paperboard cartons is disclosed whereby a carton is adapted to accommodate glassware having irregularly shaped portions such as stems, flutes, etc.

Folded paperboard cartons are commonly used as packaging for generally cylindrical objects such as cans or drinking glasses. Known cartons usually comprise a continuous sheet of paperboard wrapped around a group of glasses to form a sleeve having top and bottom panels, opposite side wall panels, and two opposite open ends for insertion and removal of the glasses. Various pieces of the sleeve panels fold inwardly against or between the glasses to hold them in place. Also, a separator panel extending between adjacent glasses is sometimes provided as an inwardly folded piece of a sleeve panel, or may be formed as a distinct panel of the carton. Examples of such carton structures are seen in U.S. Pat. Nos. 2,817,473 to Foster and 4,640,417 to Durand.

A carton is normally formed from an elongated blank sheet of paperboard. Such blank sheets have folding lines to define distinct carton panels in succession along the length of the sheet, and additional cut and scored lines to define the inwardly folding pieces of the panels. A small folding extension at one or both ends of the blank sheet can be provided as a glue flap for construction of the sheet into a closed sleeve with opposite ends thereof joined at the glue flap.

A blank sheet is constructed into a sleeve-like carton by first applying adhesive to the glue flap and then by pivoting one end of the blank sheet about a laterally extending folding line to bring that end over into engagement with the other end, whereby the blank is disposed in a flat overlapped position with the ends adhered together. The flat overlapped configuration is expanded into an open ended rectangular sleeve by moving the panels away from one another with bending action at the lateral folding lines. The glasses may then be inserted into the open ends of the sleeve, and the inwardly folding pieces appropriately engaged with the glasses.

Problems with known paperboard cartons arise with both the constructed cartons and the blank sheets. The cartons fail to provide a strong and rigid container for glasses of various shapes, and the blank sheets inefficiently require manual assembly operations after the sheets are expanded into the open sleeve configuration.

More specifically, known paperboard cartons for drinking glasses generally make no provision for stems, converging sides, or other common but irregular shapes. A glass having a narrow base can easily shift inside the carton to break against an adjacent glass or to fall out of the carton. The inwardly folding pieces of known sleeve panels have been arranged to extend between glasses or to engage the stem of a goblet, such as in U.S. Pat. Nos. 2,817,473 and 4,640,417 noted above, but removal of these pieces out of the plane of the associated sleeve panel greatly weakens the structure of the carton. A weakened carton cannot safely hold fragile drinking glasses and requires heavier and greater amounts of paperboard material to accommodate a weak structural design. In addition to weakening the panel, a stem holding piece taken from the top, bottom, or side panels of the sleeve undesirably exposes the contained glasses to impact with objects outside the carton, and when taken from an internal separator panel, a stem holding piece is difficult to reach for manipulation into place.

Known blank sheets for constructing cartons with stem holding or similar pieces inefficiently require manual manipulation of these pieces into position. Automatic equipment is used to apply adhesive to the glue flaps, and to fold the blank sheet into the overlapped flat configuration in which the cartons are stored or shipped for subsequent manual expansion and loading with drinking glasses. The manual operations of folding the stem holding pieces out of the plane of the associated panel, aligning the end or other part of the folded piece into position, and attachment thereof with adhesive are all time consuming and exacting tasks which detract from the efficiency and quality of the process.

Known cartons for drinking glasses are thus seen to fail to provide a strong and rigid container for glasses of differing shapes, or an efficient method of manufacturing such a container.

SUMMARY OF THE INVENTION

The present invention overcomes the above referred to problems and others, and provides a paperboard carton for holding drinking glasses of various shapes which is of superior strength and rigidity, and which is manufactured by an improved method.

In accordance with a principal feature of the invention there is provided a paperboard carton for holding drinking glasses having a tapered base, a stem, or other similar shape feature, the carton comprising an open ended sleeve having horizontal panels, vertical panels, and a separator panel extending between the horizontal panels to define adjacent interior compartments of the carton. An internal glass holding panel having recesses to engage a glass stem, base, or other narrow portion is disposed parallel to the bottom panel, spaced vertically above the bottom panel, and passes through the separator panel to extend continuously between the side panels. The glass holding panel has a glue flap at each end for adhesion to the side panels, and is formed as a single piece taken out of the plane of the separator panel by being rotated about a line along which it intersects and is integral with the separator panel. The glass holding panel thus securely engages the glass stems, and further rigidifies the carton while economizing the use of paperboard material.

In accordance with a more specific feature of the invention, a tab and slot arrangement similar to that shown in my copending applications is used to securely retain the glasses within the open ends of the sleeve shaped carton. Importantly, the glass holding panel is configured so that when it is rotated out of the separator panel, the remaining coplanar portions of the separator panel on opposite sides of the glass holding panel retain sufficient compressive or columnar rigidity to give support to the carton, yet are resiliently flexible to cooperate with the tabs in locking the carton.

In accordance with another principal feature of the invention, there is provided a foldable blank for construction of a carton for drinking glasses or similar objects, the blank being formed as a sheet having folding lines defining distinct panels which are pivotal with respect to one another about the folding lines. At least one of the panels is provided as a compartment separator panel and has an internal folding line extending across a portion thereof. An object holding panel is provided in part by a first section defined by a cut line on one side of the internal folding line, and in part by a second section defined by a cut line on the other side of the internal folding line so that the object holding panel is rotatable out of the plane of the separator panel about the internal folding line.

In accordance with a more specific feature of the invention, the blank is formed as an elongated sheet having laterally extending folding lines defining successive panels along the length of the sheet. The panels include a top panel at a first end, and successively towards the second end a side panel, a bottom panel, another side panel, a bridging panel, a separator panel, and a glue flap. The glue flap is interrupted in its width across the blank sheet by two cut lines defining a gap therebetween. The separator panel has an internal folding line extending laterally across a portion thereof. A glass holding panel is defined in part by a portion of the separator panel cut out on one side of the internal folding line, and in part by a portion of the separator panel cut out on the other side of the internal folding line and extending longitudinally through the gap in the glue flap to the second end of the blank sheet. The glass holding panel has a foldable glue flap at each end, and has recesses in its longitudinal edges to engage the stem or other shape feature of the drinking glasses to be held in the carton. The distinct panels of the blank sheet are pivotal with respect to one another about the laterally extending folding lines, and the glass holding panel is rotatable as a whole out of the plane of the separator panel about the internal folding line.

In accordance with yet another principal feature of the invention, there is provided a method of constructing a folded carton out of a blank paperboard sheet. First, a sheet is provided, the sheet having folding lines defining distinct panels pivotal with respect to one another about the folding lines. The panels include at least two side panels and a separator panel which defines and separates two adjacent interior compartments of the carton between the side panels. There is also provided an object holding panel defined in two sections on opposite sides of an internal folding line extending partially across the separator panel. The sections are delineated by lines cut through the blank sheet so that the object holding panel is rotatable as a whole out of the plane of the separator panel about the internal folding line. The object holding panel further has opposite end pieces which are pivotal out of the plane of the sections. The blank sheet is folded about selected ones of the folding lines so as to bring the sheet into a generally flat configuration of overlying panels with the side panels being brought into overlying contact with opposite planar sides of the end pieces, but prior to the folding step, adhesive is applied to selected portions of one planar side of the blank sheet so as to enable adhesion of the opposite planar sides of the end pieces with the overlying side panels.

A principal object of the present invention is to provide a folded paperboard carton for drinking glasses which rigidly and securely holds glasses having an irregular or non-cylindrical as well as a cylindrical shape, and which is efficiently constructed from a foldable blank sheet.

Another object of the invention is to provide a paperboard carton for drinking glasses which includes means to directly engage the stems of the glasses and to rigidify the container panels, while also minimizing the weight and amount of material required to form the container.

Another object of the invention is to provide a carton having superior retention properties out of thinner paperboard than that which is typically used, resulting in a less expensive carton.

Yet another object of the invention is to provide a carton using material punched out of an inner wall panel and folded into a plane to rigidify the carton while securing the contained objects, and being configured in a manner to make the inner wall panel more resiliently flexible for interaction with locking tabs.

A further object of the invention is to provide a blank sheet for construction of a paperboard carton for drinking glasses which provides glass stem holding components upon folding of the blank sheet into a flat configuration of overlapped planar sections, and without the need for subsequent manual manipulation of the stem holding components.

Yet another object of the invention is to provide a method of constructing a folded paperboard carton for drinking glasses having a stem or other irregular shape which erects a glass stem holding means without the need for inefficient direct handling of the glass stem holding means.

These and other objects of the invention will become apparent from the following detailed description of a preferred embodiment thereof and from the accompanying drawings.

BRIEF DESCRIPTION OF THE DRAWINGS

FIG. 1 is a pictorial view of a carton formed in accordance with the invention and containing four drinking glasses;

FIG. 2 is a sectional view taken along line 2—2 of FIG. 1;

DESCRIPTION OF A PREFERRED EMBODIMENT

Figure 4:
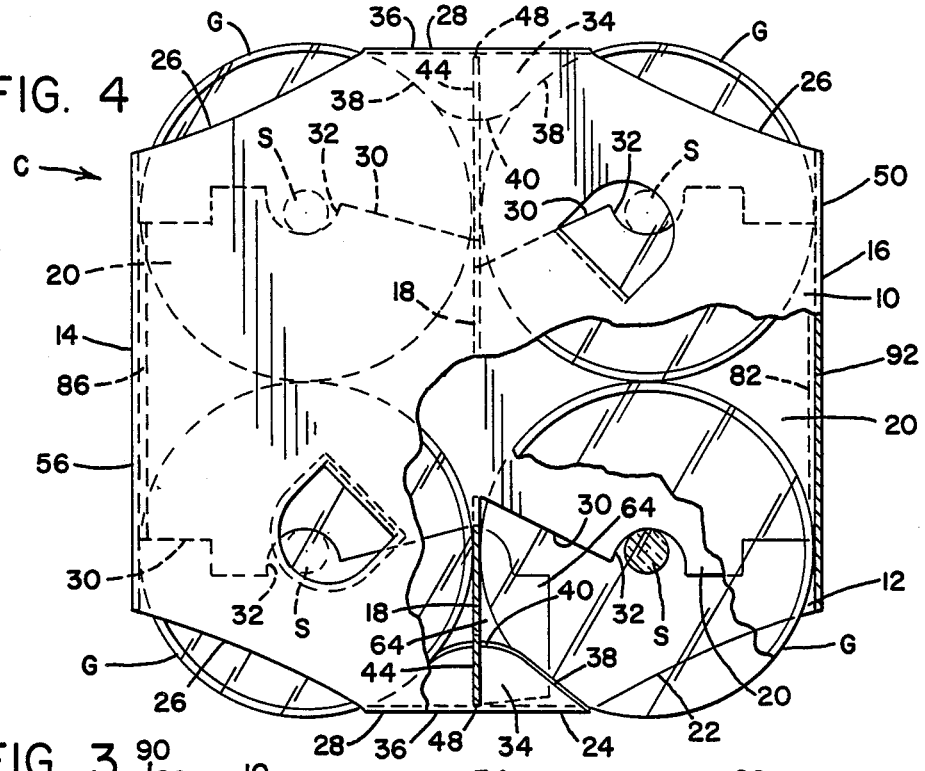
FIG. 4 is a top view of the carton shown in FIG. 1.
Figure 3:
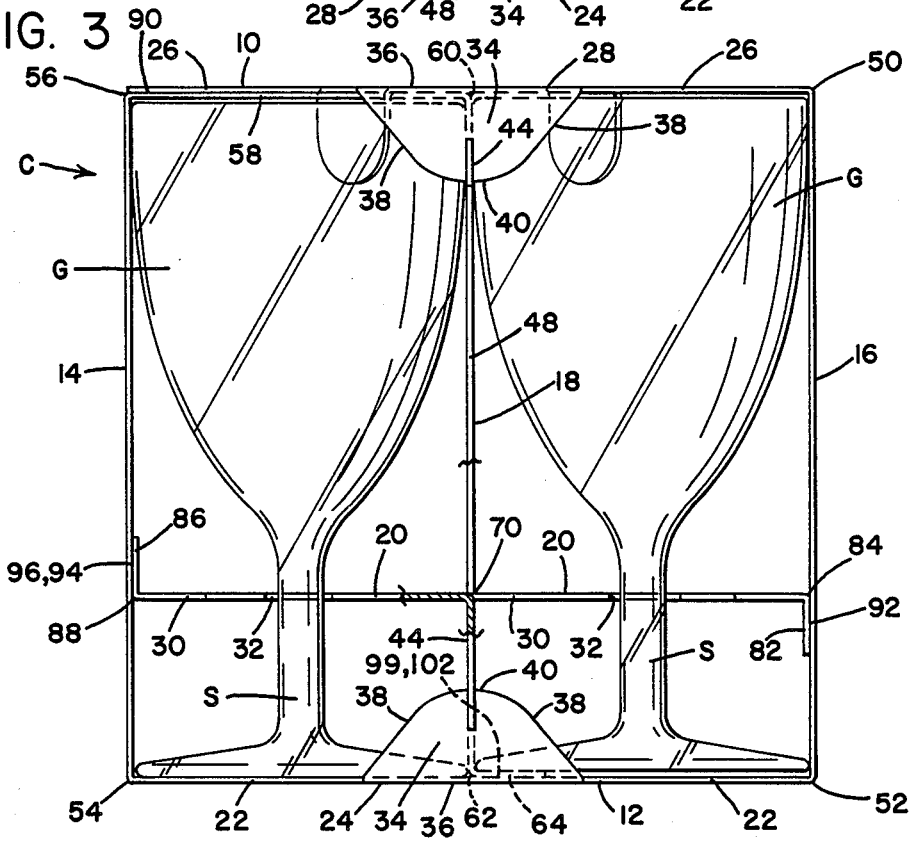
FIG. 3 is a side view taken along line 3—3 of FIG. 1.

Referring now to the drawings wherein the showings are for the purpose of illustrating a preferred embodiment of the invention only and not for the purpose of limiting same, in FIG. 1 there is shown a paperboard carton C holding wine glasses G. This embodiment is particularly adapted to accommodate the structural features of wine glasses G including narrow stem portions S, and the invention will be described with reference thereto. However, it is intended that the invention may comprise carton embodiments adapted to securely retain objects having other comparable structural features.

The Carton

Carton C comprises top panel 10, bottom panel 12, side panels 14 and 16, separator panel 18 and object holding panel 20. Top and bottom panels 10, 12 and side panels 14, 16 form a closed sleeve with opposed open ends for insertion and removal of glasses G. Separator panel 18 extends vertically between top and bottom panels 10 and 12 to define adjacent interior compartments for holding glasses G between side panels 14 and 16.

Side panels 14 and 16 are narrower between the open ends of carton C than the combined diameters of glasses G held in the associated interior compartments. Bottom panel 12 has edges 22 at each open end of carton C, including intermediate edge portions 24 extending perpendicularly to side panels 14, 16 and to separator panel 18. Edges 22 converge from intermediate portions 24 towards side panels 14 and 16 to provide the octagonal shape of bottom panel 12 shown in the figures. For the purpose of symmetry, top panel 10 is formed similarly with edges 26 having intermediate portions 28. This panel geometry reduces the amount of carton material which otherwise would cover the sides and edges of glasses G, and thereby both reduces material cost and increases product exposure for retail display and sale.

Object holding panel 20 is spaced above bottom panel 12 and extends through the plane of separator panel 18 between side panels 14 and 16. Object holding panel 20 is narrower between the open carton ends than is bottom panel 12, and has edges 30 including recesses 32 adapted to register with stems S of glasses G. Edges 30 can, of course, take any other configuration adapted to a particular structural feature of the object to be held in carton C, such the fluted portion of a champagne glass, the widest portion of a barrel shaped glass or cup, or simply the outline of a cylinder. Object holding panel 20 is formed integrally with separator panel 18 in a manner to be described in greater detail below with reference to the blank sheet from which carton C is formed.

Means are provided to securely retain glasses G within the open ends of carton C. As best seen in FIGS. 9–12, locking tabs 34 are provided at each intermediate edge portion 24 of bottom panel 12. Each tab 34 is defined by a base line 36 coincident with the juncture of the tab with bottom panel 12, by tab edges 38 converging from base line 36, and by a narrow tab end 40 which may be linear to give the tabs a trapezoidal shape, but which is preferred to be curved away from base line 36 as shown. Tabs 34 are pivotal about base lines 36.

Separator panel 18 includes a locking slot 42 associated with each tab 34. Slots 42 are inclined inwardly and vertically with respect to bottom panel 12, and have open ends adjacent base lines 36. A region 44 of separator panel 18 is defined adjacent each slot 42 and extends along each outer edge 48 of separator panel 18. Regions 44 are resiliently flexible out of the plane of separator panel 18. While a single tab could hold the glasses G within an open end of the sleeve, in order to enhance the security of carton C for holding fragile objects, locking tabs 34 are also provided at intermediate portions 28 of edges 26 at top panel 10, with additional locking slots 42 similarly associated therewith as shown in the figures.

Figure 9:
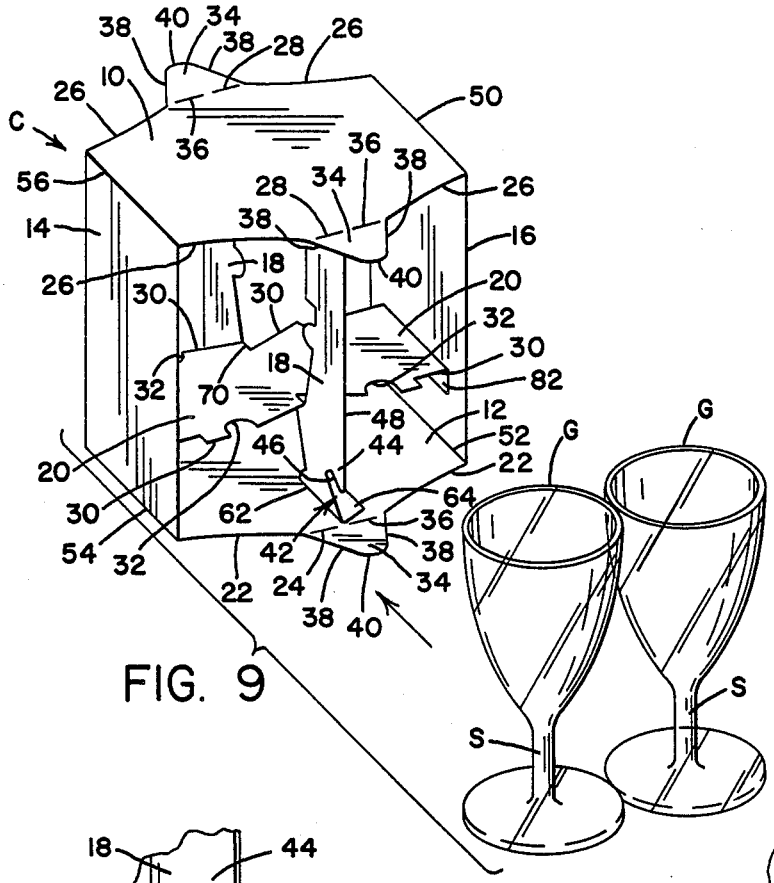
FIG. 9 is a pictorial view of the carton shown in FIG. 1 in an open position preparatory for insertion of a pair of drinking glasses.
Figure 10:
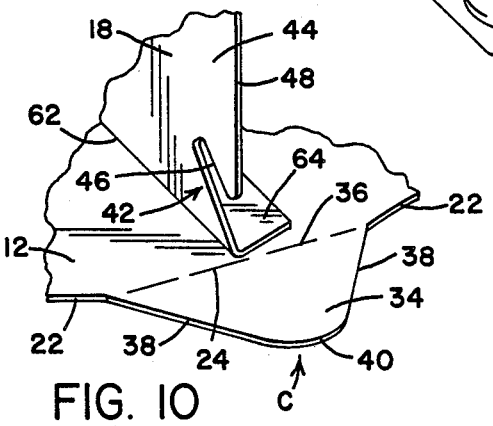
FIG. 10 is a pictorial view of a locking means portion of a carton in accordance with the invention.
Figure 11:
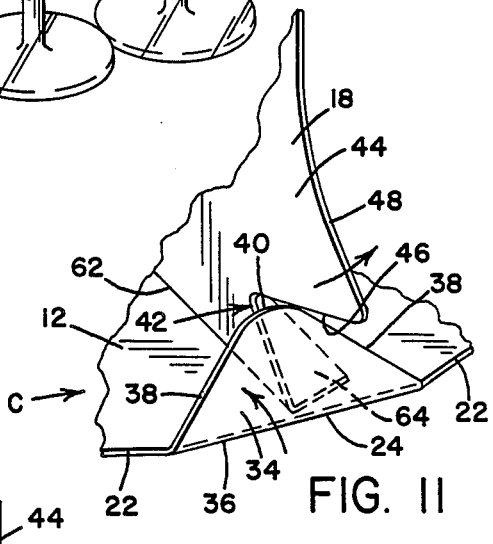
FIG. 11 is a pictorial view of the locking means shown in FIG. 10 in a partially locked position.
Figure 12:
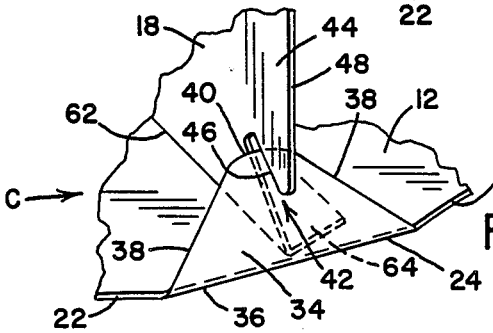
FIG. 12 is a pictorial view of the locking means shown in FIGS. 10 and 11 in a fully locked position.

In use, an empty carton C is arranged to receive glasses G inwardly at the open ends thereof as shown in FIG. 9. A glass G is inserted into a carton compartment on either side of separator panel 18 with the stem S received in recess 32 of object holding panel edge 30. The associated region 44 of separator panel 18 is then flexed out of its plane to permit pivotal movement of tab 34 about base line 36 into a locking position received within slot 42, whereupon region 44 is permitted to resiliently return to its original position as a coplanar element of separator panel 18. Tab 34 is then locked into slot 42 against outer slot edge 46 and will prevent movement of glass G out of the open carton end unless the tab is intentionally pivoted outwardly past panel region 44.

Importantly, the configuration of the object holding panel 20 is such that the void left thereby in the separator panel 18 contributes to the resilient flexibility of the separator panel 18 at each region 44 associated with a tab and slot arrangement, whereby each region 44 can flex independently without causing a crease to form in the paperboard material. At the same time, the void formed in the separator panel 18 is not so great as to detract from the columnar rigidity thereof. Furthermore, the object holding panel 20 acts as a stiffener to increase rigidity and thereby more than compensates for any loss of rigidity in the separator panel 18 which might otherwise occur. Increased rigidity enables a lighter weight material to be used. For example, prior cartons commonly use heavier paperboard material of 0.032–0.034 caliper, whèras the present invention enables a reduction to lighter material of about 0.024 caliper.

The improved combination of flexibility with rigidity in the separator panel 18 is an advantageous feature of the invention because, as seen in my copending applications, the tabs are planar pieces, and the locked engagement of these two intersecting planar members securely retains the glasses G within the carton against any outward force short of one causing destructive bending failure of the planar configurations. The security of the tab and slot arrangement also enables an advantageous reduction in weight of the paperboard material even without the rigidifying properties of the object holding panel 20.

Object holding panel 20 further contributes to the glass holding security of carton C. A glass G is prevented from movement out of the opposite open end of carton C when a companion glass is removed from the same interior compartment. Furthermore, glasses G cannot rattle about within the carton and strike against one another when stems S are secured within recesses 32.

The Blank Sheet

Figure 5:
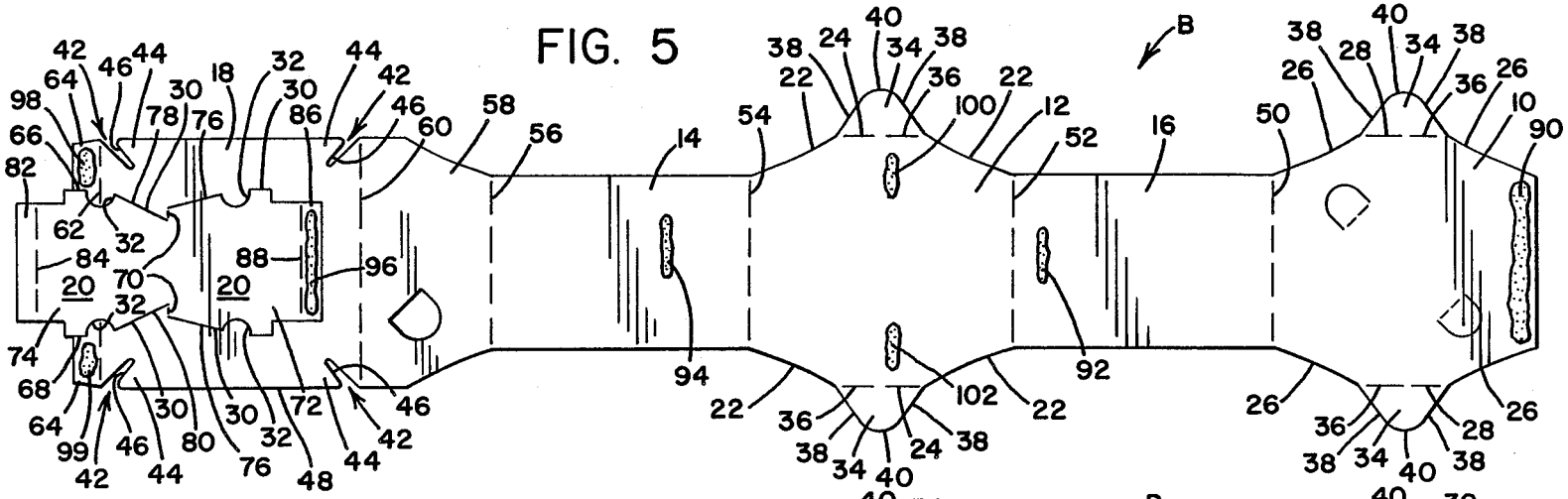
FIG. 5 is a plan view of a blank form adapted for construction of a carton in accordance with the invention.
Figure 6:
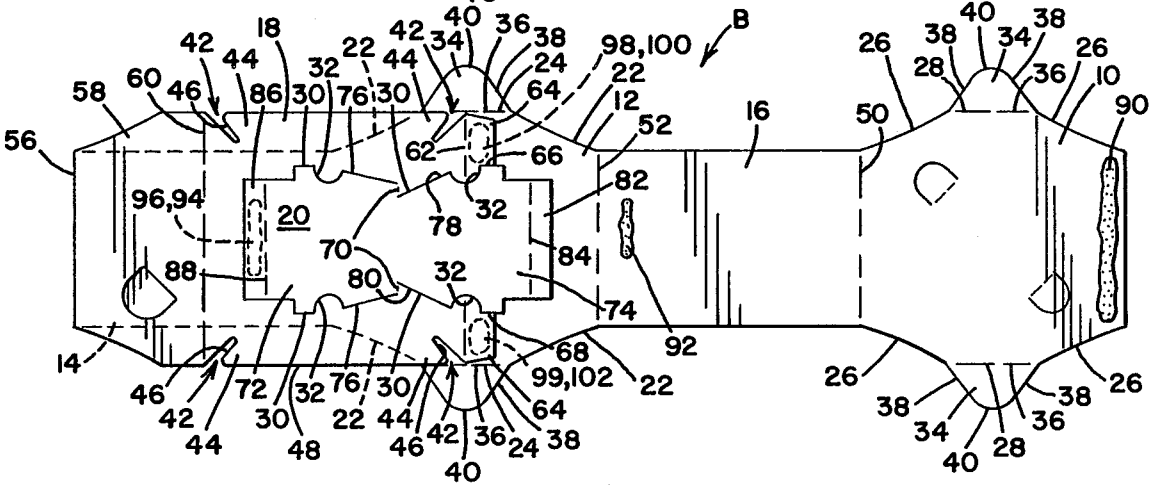
FIG. 6 is a plan view of the blank form shown in FIG. 5 in a folded position partially constructed into a carton in accordance with the invention.

Referring now to FIG. 5, there is shown a paperboard blank B adapted to be constructed into the form of carton C. Blank B is an elongated sheet of paperboard having laterally extending folding lines defining successive panels along the length of the sheet. Proceeding in longitudinal succession from right to left in FIG. 5, the panels include top panel 10 extending from folding line 50, side panel 16 between folding lines 50 and 52, bottom panel 12 between folding lines 52 and 54, side panel 14 between folding lines 54 and 56, bridging panel 58 between folding lines 56 and 60, separator panel 18 between folding lines 60 and 62, and glue flap 64 extending from folding line 62. Glue flap 64 is interrupted in its width across blank B by cut lines 66 and 68. Each panel is pivotal with respect to an adjacent panel about the lateral folding line extending therebetween.

Object holding panel 20 described above is formed within blank B as a component of separator panel 18. Separator panel 18 includes internal folding line 70 extending partially thereacross with object holding panel 20 defined by sections 72 and 74 on opposite sides of internal folding line 70. Section 72 is defined by cut line 76 extending around section 72 between the ends of internal folding line 70. Section 74 is defined in part between cut lines 78 and 80 reaching from internal folding line 70 to lateral folding line 62, and continues longitudinally beyond lateral folding line 62 between cut lines 66 and 68 to extend to end flap piece 82. End flap piece 82 is pivotal out of the plane of section 74 about folding line 84. A similar pivotal end flap piece 86 with folding line 88 is provided at the opposite end of section 72. Object holding panel 20, in the form of sections 72 and 74, is rotatable as a planar unit about internal folding line 70 to turn out of the plane of separator panel 18.

Construction Of The Carton

A method of folding blank B into the form of carton C is illustrated in sequential steps in FIGS. 5–8. First, adhesive is applied at selected areas of one planar side of blank B as illustrated in FIG. 5. Adhesive is applied to top panel 10 at an area designed generally at 90, and to side panel 16 at an area designated generally at 92. Adhesive is also applied to another area which may be either area 94 at side panel 14 or area 96 at end flap piece 86 on object holding panel 20. Adhesive is further applied to either glue flap 64 at areas 98 and 99, or to bottom panel 12 at areas 100 and 102. Panels of blank B shown to the left of lateral folding line 56 are then pivoted as a planar group about line 56 into the overlying configuration shown in FIG. 6, whereby end flap piece 86 becomes adhered to side panel 14 at area 94, and glue flap 64 becomes adhered to bottom panel 12 at area 100 and 102.

Figure 7:
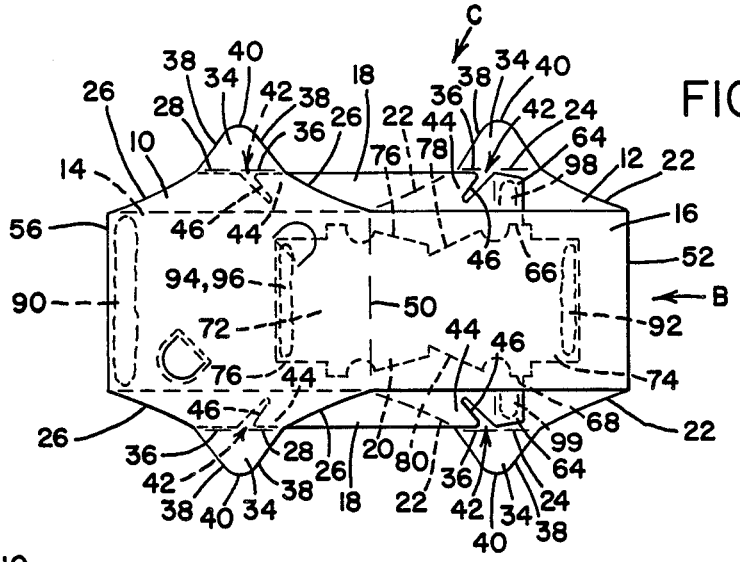
FIG. 7 is a plan view of the blank form shown in FIG. 6 in a folded position further advanced toward construction of a carton in accordance with the invention.

Panels of blank B to the right of lateral folding line 52 are then pivoted as a planar group about line 52 into the overlying configuration shown in FIG. 7. This folded configuration of blank B places areas 90 of top panel 12, which is on one planar side of blank B, in overlying contact with the other planar side of blank B at bridging panel 58. Likewise, opposite planar sides of blank B are placed in overlying contact where area 92 of side panel 16 is brought around onto end flap piece 82. Blank B as folded and adhered in FIG. 7 is sufficiently constructed into carton C to the extent necessary for storage or shipment.

Figure 8:
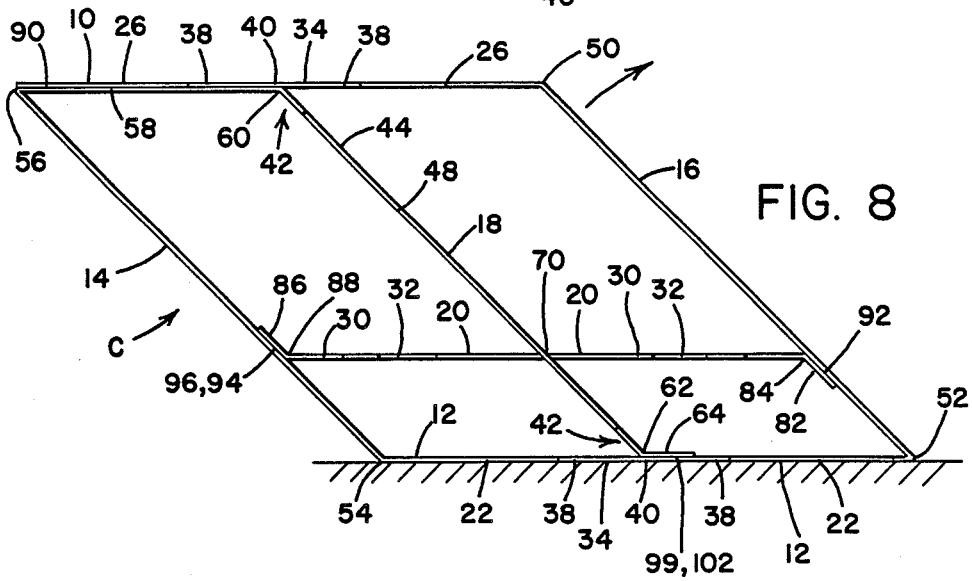
FIG. 8 is a side view of the blank form shown in FIG. 7 in a folded position partially expanded outwardly into a completed carton in accordance with the invention.

The final step in construction of carton C is illustrated in FIG. 8 whereby the flat folded configuration of FIG. 7 is expanded by means of pivotal motion about lateral folding lines 50, 52, 54 and 56 to produce the upright rectangular structure shown in FIG. 9. In accordance with the invention, adhesion of end flap pieces 82 and 86 respectively to side panels 16 and 14 causes object holding panel 20 to pivot as a planar unit out of the plane of separator panel 18 as side panels 14 and 16 are expanded into the upright rectangular position.

In addition to providing retention security for glasses G within carton C, object holding panel 20 increases the strength and rigidity of the carton structure while minimizing the amount and weight of paperboard material required. The geometry of top panels 10, 12 and side panels 14, 16 described above, or other reductions of panel coverage around objects held within a carton, could reduce the strength and rigidity of the structure. Object holding panel 20 rigidifies separator panel 18 and side panels 14, 16 by tying these members together across the interior of the structure. Provision of object holding panel 20 as an integral component of separator panel 18 within blank B avoids the need for an additional panel to perform this rigidifying function, and thus minimizes the amount of material used while simultaneously increasing strength.

The invention has been described with reference to the preferred embodiment. Obviously, modifications and alternations will occur to others upon the reading and understanding of this specification. It is intended to include all such modifications insofar as they come within the scope of the appended claims or equivalents thereof.

Having thus described the invention, it is claimed:

1. A folded carton for drinking glasses or similar objects formed from a sheet of paperboard material and comprising:

horizontal and vertical panels forming a sleeve having opposed open ends for insertion and removal of said objects, said horizontal panels forming a top and bottom of said sleeve and said vertical panels forming outer side walls of said sleeve;

a separator panel in said sleeve extending between said horizontal panels to define adjacent interior compartments; and an object holding panel extending continuously, as a single piece formed from said paperboard material, between opposite ends connected to said outer side walls, having a horizontal portion extending through the plane of said separator panel, and being formed integrally with said separator panel along a horizontal line at which said object holding panel intersects the plane of said separator panel.

2. A carton as defined in claim 1 wherein said objects holding panel has edges formed from said paperboard material with a contour conforming with the cross sectional outline of a portion of said objects.

3. A carton as defined in claim 1 wherein said object holding panel further includes a flap piece at each end of said horizontal portion extending from said horizontal portion in a direction parallel to the associated outer side wall.

4. A carton as defined in claim 1 wherein said horizontal panels have end edges at said open ends of said sleeve, at least one of said horizontal panels having a unitary flat planar locking tab extending from a base line extending along a portion of each said end edge to a free tab end narrower than the length of said base line, said tabs being pivotal about said base line between an open position extending outwardly of said open sleeve end and a locked position extending inwardly of said open sleeve end, said tabs in said locked position retaining said unitary flat planar configuration, said separator panel having a slot adjacent each said tab for receiving said tabs therewithin in said locked position.

5. A carton as defined in claim 4 wherein said slots extend vertically and inwardly with respect to said base lines each to define a locking component of said separator panel between said slot and said open end of said carton, said locking components having a vertical length sufficient to block pivotal movement of said tabs in said flat planar configuration into or out of said slots, and being resiliently flexible out of the plane of said separator panel to permit said pivotal movement of said tabs.

6. In a foldable blank for construction of a carton for drinking glasses or similar objects comprising a sheet having panel folding lines defining distinct planar panels pivotal with respect to one another about said panel folding lines, the improvement comprising: at least one of said panels having first and second ends and an internal folding line extending across a portion thereof; and an object holding panel having a first section defined by a first cut line extending on one side of said internal folding line and a second section defined by a pair of second cut lines extending on the other side of said internal folding line, said second cut lines extending from said internal folding line to said second end, said second section of said object holding panel extending from said internal folding line between said second cut lines and beyond said second end, said object holding panel being rotatable out of the plane of said one panel about said internal folding line into a rotated position wherein said first and second sections extend from said internal folding line on opposite sides of said plane.

7. A foldable blank sheet for construction of a carton for drinking glasses or similar objects comprising:

an elongated sheet having laterally extending folding lines defining successive planar panels along the length of said sheet, said panels comprising, in longitudinal succession a top panel, a first side panel, a bottom panel, a second side panel, a bridging panel, a separator panel, and a glue flap;

said glue flap being interrupted in its width across said blank sheet by a pair of cut lines extending across said glue flap;

said separator panel including an internal folding line extending laterally across a portion thereof, and an object holding panel defined in part by a first section of said separator panel cut out on one side of said internal folding line and in part by a second section of said separator panel cut out on the other side of said internal folding line and extending longitudinally between said cut lines in said glue flap, said object holding panel being rotatable as a whole out of the plane of said separator panel about said internal folding line with said first and second sections thereby being disposed on opposite sides of said plane.

8. A foldable blank sheet as defined in claim 7 wherein said object holding panel includes a piece at each longitudinal end thereof adapted to be folded out of the plane of said object holding panel.

* * * * *